United States Patent [19]

Marzec et al.

[11] 4,288,041

[45] Sep. 8, 1981

[54] SHUTTLELESS TOROIDAL CORE WINDER

[75] Inventors: Willy Marzec, San Diego; James D. Lint, Santee, both of Calif.

[73] Assignee: Varian Associates, Inc., Palo Alto, Calif.

[21] Appl. No.: 101,829

[22] Filed: Dec. 10, 1979

[51] Int. Cl.[3] ..... H01F 41/08

[52] U.S. Cl. ..... 242/4 R; 72/148; 140/92.1; 242/4 C

[58] Field of Search ..... 242/4 R, 4 A, 4 B, 4 C; 72/148; 140/92.1

[56] References Cited

U.S. PATENT DOCUMENTS

| | | | |
|---|---|---|---|
| 3,333,779 | 8/1967 | Rey | 242/4 B |
| 3,383,059 | 5/1968 | Fahrback | 242/4 B |
| 3,967,786 | 7/1976 | Ivanor | 242/4 R |
| 3,985,310 | 10/1976 | Kent et al. | 242/4 R |

*Primary Examiner*—Billy S. Taylor

*Attorney, Agent, or Firm*—Stanley Z. Cole; Peter J. Sgarbossa

[57] ABSTRACT

Disclosed is an apparatus for simultaneously winding multiple strands of wire into turns about a toroidal core in rapid fashion. The apparatus includes a U-shaped wire receiving channel having a semi-circular portion with a gap and a pair of open-ended legs. The ends of the channel legs are positioned adjacent opposite sides of a rotatably mounted drum which is driven by a resilient endless belt engaging approximately one half of its annular outer surface. A toroidal core is supplied and rigidly supported in the gap by a core feeding mechanism. A grooved gap crosser is thereafter extended through the central opening of the core to bridge the gap and complete the channel. A pair of pinch roller type feed/brake mechanisms propel and guide the leading ends of the wires into the channel, through the core opening, and up one channel leg to the drum. There the wires are frictionally held between the drum and the belt and they are positively driven into the other channel leg, through the core opening, and back to the drum. Continued feeding of the wire results in the formation of a coil having a plurality of vertically stacked, oval-shaped loops which extend through the core opening and are alternately made of different ones of the wires. Thereafter, staggered braking of the trailing ends of the wires causes the loops to be successively peeled radially inwardly from the channel and the drum as the coil is continuously circulated. The loops are tightened into turns about the core as it is slowly rotated about its axis by the core feeding mechanism. First and second shear mechanisms cut off the trailing and leading ends of the wires at the beginning and end of the winding operation, respectively.

11 Claims, 18 Drawing Figures

SHUTTLELESS TOROIDAL CORE WINDER

BACKGROUND OF THE INVENTION

The present invention relates to an apparatus for winding successive convolutions of one or more continuous strands of material onto a selected workpiece. More particularly, it concerns an improved apparatus for winding strands of wire onto ring-shaped articles, such as toroidal cores. As used herein, the term "core" means a ring-shaped article having the plane closed curve cross section of a toroid, or any one of various other different cross sections. The term "wire" as used herein means any material in the form of a flexible strand which is not so supple that it buckles easily when pushed from one end in a length-wise direction. The terms "continuous wire supply" and "continuous wire source" mean that the length of continuous wire in the supply coil or source is sufficiently long to enable a plurality of cores to be wound from the supply or source before the wire is used up. As used herein the term "oval-shaped" refers to a closed curve formed from two semicircular curves of equal radius connected by two straight-line segments of equal length.

Wire wound ferrite cores have been used as electronic components for many years. They are particularly adapted for producing a gapless magnetic field. Inductance coils and transformers can be constructed in this manner. Rheostats can be constructed with cores wound with resistance wire. Very small wire wound cores have also been used as memory elements in computers.

Heretofore, the wire has often been wound onto such cores by hand. This process is time consuming and tedious and frequently results in inferior coils due to non-uniform spacing of the wire turns around the core. More recently, the wire has been wound onto such cores through the use of a rotating winding ring or shuttle which carries several loops of wire and rotates at high speed through the central aperture of the core. U.S. Pat. No. 2,810,530 discloses an exemplary apparatus for winding cores in this manner. Such apparatus require the constant attention of an operator who must mount each core, manually wind the appropriate number of loops of wire about the shuttle, and remove the core from the shuttle upon the completion of the winding operation.

Improved winding apparatus have been developed which do not require the insertion of a winding ring or shuttle, or any other element through the central aperture of the core. Instead, a coil of wire is formed which extends through the central aperture of the core. Individual turns about the core are made from the loops of the coil during continuous rotation of the coil. One such apparatus is disclosed in U.S. Pat. No. 3,132,816. In that apparatus, loops of wire are apparently held frictionally between the engaging faces of two ring-like belts which are rotatably driven about their central axes. The wire loops pass through the center of a core supported between separated portions of the belts. The trailing end of the wire is rigidly held so that as the coil rotates the wire loops are wound into turns about the core.

Finally, U.S. Pat. No. 3,985,310, owned by the assignee of the present application, disclosed a superior shuttleless core winding apparatus invented by the Kent brothers. A length of wire is fed into a radially inwardly facing annular channel through a curved feeding tube. The wire is propelled around the channel by two pairs of driven pinch rollers to form a number of radially spaced circular loops. The upper and lower boundaries of the channel maintain the loops in a single concentric layer. A gap is provided in the channel for receiving the core so that as each circular loop is formed, the wire in that loop passes through the core opening. When enough wire has been fed the trailing end of the wire is held. The circulation of the loops through the core opening continues and each loop is wound into turns about the core, one new turn being completed for each circulation of the loops around the annular channel. The winding of two or more wires simultaneously around the core (known as bifilar and multi-filar winding) can also be accomplished with the Kent brothers apparatus.

It is believed that the Kent brothers' apparatus of U.S. Pat. No. 3,985,310 represents the best prior art device for high speed manufacture of wire wound cores. However, this apparatus has certain limitations. Because the wire loops are formed into a single concentric layer within the circular channel, provisions must be made to insure that each loop is driven around the channel at an angular velocity which is equal to or greater than that of any loop radially outwardly of it. If the angular velocity of any inner loop were less than that of any outer loop, the inner loops would circulate around the channel more slowly and would get larger and jam against the outer loops, preventing proper winding of the core. To avoid this result, the driven pinch rollers are not cylindrical but instead are bevelled and supported at an angle to each other as illustrated in FIG. 3 of the patent. Roller wear and imprecise positioning of the rollers can result in an improper speed relationship between the concentric wire loops, and this will often terminate the winding operation.

Furthermore, the loop capacity of the Kent brothers' apparatus is relatively small and this places an upper limit on the number of turns that can be wound around the core. If too many loops are formed within the channel of the apparatus, it is difficult to maintain the required radial speed relationship. This often results in jamming or buckling of the loops. Finally, the Kent brothers' apparatus is well suited for winding the cores with smaller wire such as 31 to 38 gage. The winding of larger cores with heavier gage wire, for example 12 gage wire, requires considerably greater operative tension. The opposing pairs of driven pinch rollers are not well suited for providing sufficient positive driving force to enable heavier gage wire to be wound around larger cores. Winding with heavier wire also requires positive guidance of the wire on both its inner and outer boundaries as the loops are formed and circulated. In the Kent brothers' apparatus there is no inner boundary guidance.

SUMMARY OF THE INVENTION

A primary object of the present invention is to provide an improved shuttleless toroidal core winder.

Another object of the present invention is to provide an improved shuttleless toroidal core winder in which the loops of the coil of wire which is circulated through the central opening of the core are vertically stacked and are driven at a uniform tangential velocity to facilitate proper winding of the core.

A further object of the present invention is to provide an improved shuttleless toroidal core winder having an improved mechanism for positively driving the coil of wire to insure proper core winding.

Still another object of the present invention is to provide an improved shuttleless toroidal core winder having a significantly increased loop capacity so that greater numbers of turns may be wound about a core.

A further object of the present invention is to provide an improved shuttleless toroidal core winder apparatus in which positive guidance of the wire on both its inner and outer boundaries is provided as the loops are formed and circulated so that the apparatus can be utilized with a wide range of wire gage sizes.

Finally, another object of the present invention is to provide an improved shuttleless toroidal core winder capable of automatically and rapidly producing precision multifilar wound cores.

Other objects and advantages of the present invention will become apparent from the following summary and detailed description, taken in conjunction with the drawings.

Disclosed is an apparatus for simultaneously winding multiple strands of wire into turns about a toroidal core in rapid fashion. The apparatus includes a U-shaped wire receiving channel having a semicircular portion with a gap and a pair of open-ended legs. The ends of the channel legs are positioned adjacent opposite sides of a rotatably mounted drum which is driven by a resilient endless belt engaging approximately one half of its annular outer surface. A toroidal core is supplied and rigidly supported in the gap by a core feeding mechanism. A grooved gap crosser is thereafter extended through the central opening of the core to bridge the gap and complete the channel. A pair of pinch roller type feed/brake mechanisms propel and guide the leading ends of the wires into the channel, through the core opening, and up one channel leg to the drum. There the wires are frictionally held between the drum and the belt and they are positively driven into the other channel leg, through the core opening, and back to the drum. Continued feeding of the wire results in the formation of a coil having a plurality of vertically stacked, oval-shaped loops which extend through the core opening and are alternately made of different ones of wires. Thereafter, staggered braking of the trailing ends of the wires causes the loops to be successively peeled radially inwardly from the channel and the drum as the coil is continuously circulated. The loops are tightened into turns about the core as it is slowly rotated about its axis by the core feeding mechanism. First and second shear mechanisms cut off the trailing and leading ends of the wires at the beginning and end of the winding operation, respectively.

DESCRIPTION OF THE PREFERRED EMBODIMENT

Figures 1, 2:
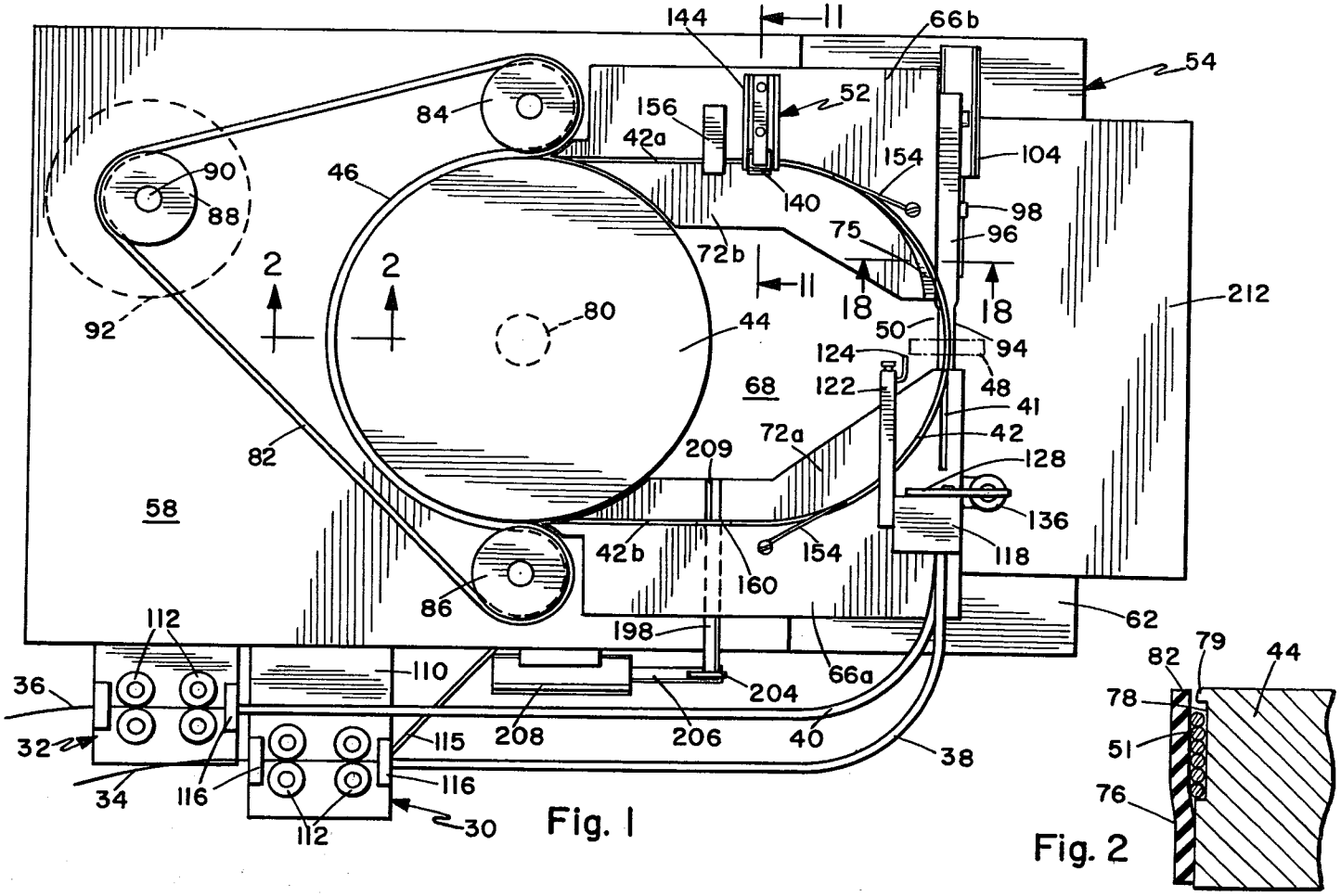
FIG. 1 is a top plan view of a preferred embodiment of the apparatus. Not shown in this Figure is the core feeding mechanism.
FIG. 2 is an enlarged sectional view taken along line 2—2 of FIG. 1.

Referring to FIG. 1, the illustrated embodiment of the shuttleless toroidal core winder is set up for bifilar winding and therefore includes dual wire feeding and braking means 30 and 32 for feeding first and second wire strands 34 and 36 respectively from different continous wire sources such as large wound spools (not shown). The feeding and braking means have powered opposing pinch rollers for driving the wire strands through curved metal guide tubes 38 and 40 into a tangential slot 41. The slot directs the wires into the semicircular portion of a generally U-shaped wire receiving channel 42 formed by a series of interengaging plates as hereafter described. The open-ended legs of the channel are positioned adjacent opposite sides of a relatively large drum 44. Endless belt means 46 engage a portion of the outer surface of the drum for drivingly rotating the same about its vertical axis. The wire strands are fed through a core 48 rigidly supported in a gap 50 in the U-shaped channel by a core feeding mechanism (not shown in FIG. 1). The core 48 (see configuration in FIG. 4) is supported in the gap so that its central axis is normal to the axis of rotation of the drum 44.

The wire strands 34 and 36 are guided into the slot and the channel and travel up one leg **42*a* of the channel toward the drum 44. There the wires are frictionally held between the drum and the belt means 46 and they are positively driven around the drum into the other leg 42*b* of the U-shaped channel. Continued feeding of the strands by the feeding and braking means 30 and 32 forms a coil 51 (FIG. 2**) of wire consisting of a plurality of generally oval-shaped, vertically stacked loops, each loop extending through the core opening.

When enough wire has been formed into loops, the trailing ends of the strands are rigidly held by the feeding and braking means 30 and 32 (FIG. 1), but the circulation of the loops about the U-shaped channel and the drum continues. When this occurs, the uppermost loop is peeled radially inwardly out of the channel and away from the drum (see FIGS. 15 and 16). One of the new turn of wire is thereafter tightened onto the core for each successive revolution of the coil and resulting peeling away of a loop (see FIG. 17). An adjustable wire release means 52 insures that each turn is suitably tightened onto the core before the next loop peels away.

At this point a narrative discussion of the method by which the illustrated embodiment of the apparatus winds the wire about the core will be set forth. This will facilitate an understanding of the function of each of the components of the apparatus hereafter desscribed in detail and the manner in which they cooperate to provide an improved shuttless toroidal core winder. For simplicity, the following discussion will be limited to the case where a single strand of wire is wound about the core.

Broadly speaking, the disclosed apparatus is capable of winding a core with a length of wire having a free leading end from a continuous wire supply. It forms the length of wire into a coil having a plurality of generally oval-shaped loops which extend through the core opening by repeatedly circulating the leading end of the wire through the core opening about the coil axis. When the desired length of wire has been formed into this coil, the wire is wound onto the core by halting the feeding of the wire from the remaining wire supply while continuing to circulate the coil through the core opening until the desired number of turns has been wound about the core. The turns are formed at the rate of not less than 1 turn for each complete revolution of the coil.

The loops are formed by feeding the wire into the U-shaped channel of the apparatus so that it is frictionally held between the drum and the belt means of the apparatus to propel it about a generally oval-shaped path. As the wire circulates about this path, it passes through the core supported in the gap. The core is preferably positioned so that it is spaced equal distances from the upper and lower boundaries of the channel. This permits as many loops as are required for winding the core to fit within the aperture in a single vertically extending layer. The channel preferably has a width of from between about 1 to about 2 times the diameter of the wire so that the loops are maintained in a single layer to permit them to be readily peeled from the channel as later described without tangling, buckling or jamming.

The wire fed into the curved channel passes through a guide tube whose forward end is downwardly inclined and extends generally tangentially to the semicircular portion of the channel. The guide tube feeds the wire into the tangential slot which in turn guides the wire into the curved portion of the channel. This arrangement insures that the wire will smoothly enter the channel, thus facilitating the formation of the loops.

As the feeding of the wire continues, each new loop is formed on top of the previously formed loop. When enough wire has been formed into loops, the feeding of the wire stops, but the circulation of the loops around the channel and around the drum continues. When this occurs, the uppermost loop is peeled radially inwardly out of the channel, away from the other loops, and away from the drum and the belt means. A portion of this loop is tightened into a turn around the core. One new turn of wire is tightened onto the core for every complete circulation of the loops. After each turn is formed, the remaining portion of the loop which just peeled away is fed back into the channel. Thereafter, another loop is again peeled away, which comprises a major portion of the previous loop plus an additional portion of the coil not previously peeled away. Thus, if one were to observe the winding operation with the naked eye, he or she would see loops of wire being repeatedly peeled out of the channel and away from the drum and the belt means, and thereafter fed through the core and back into the channel. By this process, the coil is wound around the core in increments, each increment being formed into one turn about the coil.

The adjustable wire release means mounted on top of the channel facilitates the tightening of a turn of wire around the core before allowing the next loop to peel away from the channel. It thus prevents the remaining loops from disengaging prematurely. It can be adjusted to vary the tightness or tension of the turns.

When a predetermined number of turns have been wound onto the core, the winding stops. The trailing end of the wire can be cut off anytime after the first turn has been formed around the core since one end of the wire will then be anchored about the core and continued circulation of the coil by the drum and belt means will maintain the peeling action. To prevent slippage, more turns may be required before the trailing end is cut off. It is necessary to feed more wire into the channel than will be wound about the core. The first loop formed in the channel is the last to be wound about the core and at the conclusion of the winding operation, the leading end of the wire constitutes an excess and it is cut off. Thereafter, the wound core is removed and a new one put in its place and the process is begun again.

The disclosed apparatus includes a core feeding mechanism which slowly rotates the core as the loops circulate so that each turn is wound on at a point adjacent the last turn rather than on top of that turn. It is preferred to cut off the trailing end of the wire after enough turns have been wound around the core to anchor the wire so that the core is free to be rotated to accomodate new turns.

The disclosed apparatus is also capable of winding a core with two or more different wire simultaneously so that each turn on the core is formed from a different wire. If two wires are used (bifilar winding), ever other turn on the core is formed from the same wire. If three or four wires are used, the turns are formed in order, from wires one, two and three, then one, two and three again, and so forth.

When the bifilar winding is desired, the basic winding method just described is performed by the apparatus, except that after the first wire has been fed part way around the channel, the second wire is preferably fed beneath the first wire. Also, preferably, the noses or leading ends of these wires are staggered one behind the other in order to prevent them from tangling with each other before they enter the channel. If a trifilar winding is desired, each wire is preferably fed beneath the previous one and all three leading ends are staggered with respect to each other.

When two or more wires are simultaneously wound about the core, with the apparatus of the present invention, it is important to stagger the times at which the feeding of each wire is stopped and peeling begins. This is true regardless of how far apart their noses are staggered. The wire forming the uppermost loop must be stopped first and those forming loops beneath it, each in turn, so that the uppermost loop will peel away from the others in order. This insures that each wire will be wound about the core without crossing over the others which would result in tangling.

Figures 3, 4, 18:
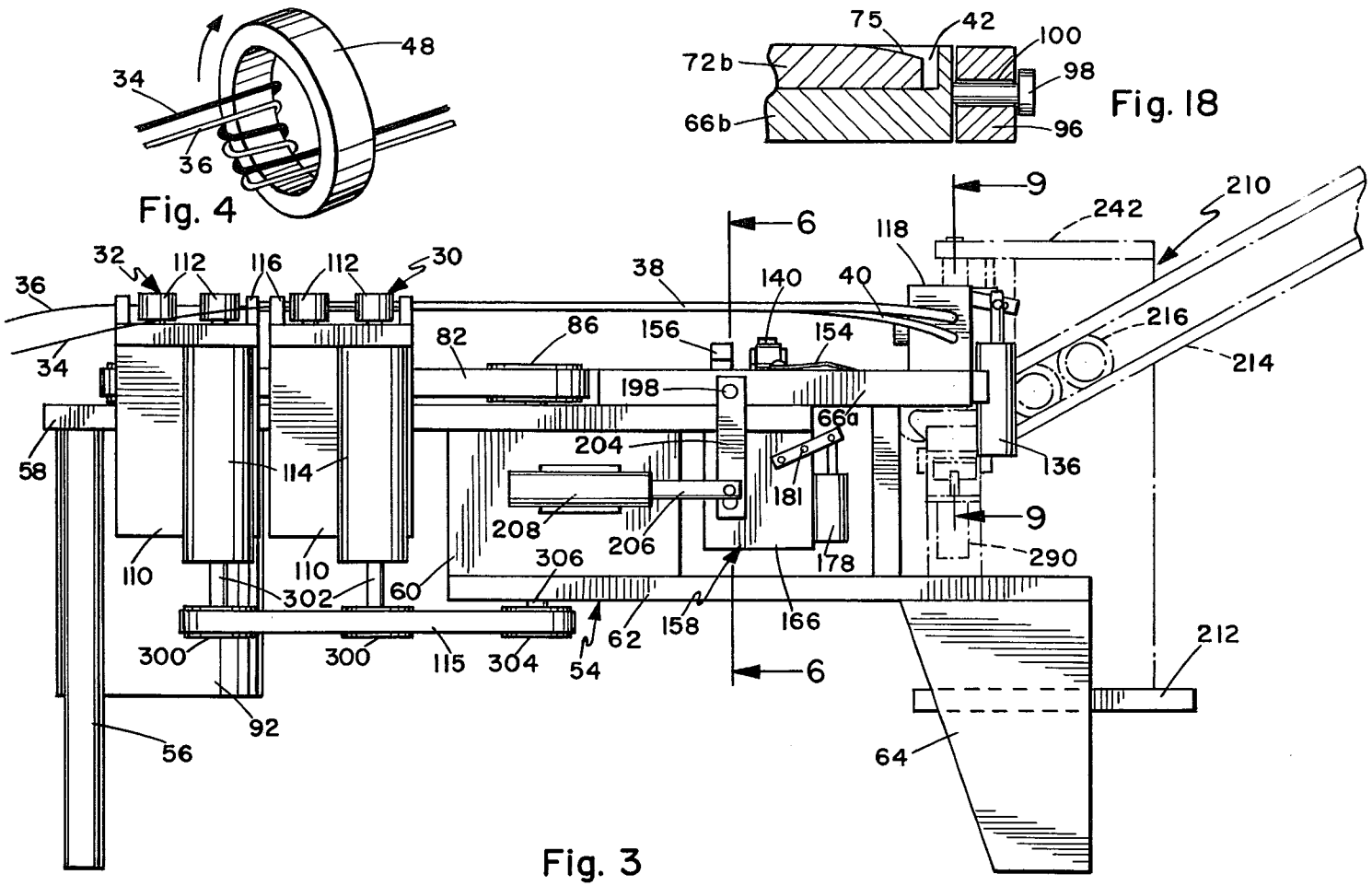
FIG. 3 is a side elevation view of the apparatus of FIG. 1, showing the core feeding mechanism in phantom lines.
FIG. 4 illustrates a bifilar winding on a toroidal core.
FIG. 18 is an enlarged fragmentary vertical sectional view taken along line 18—18 of FIG. 1.
Figure 5:
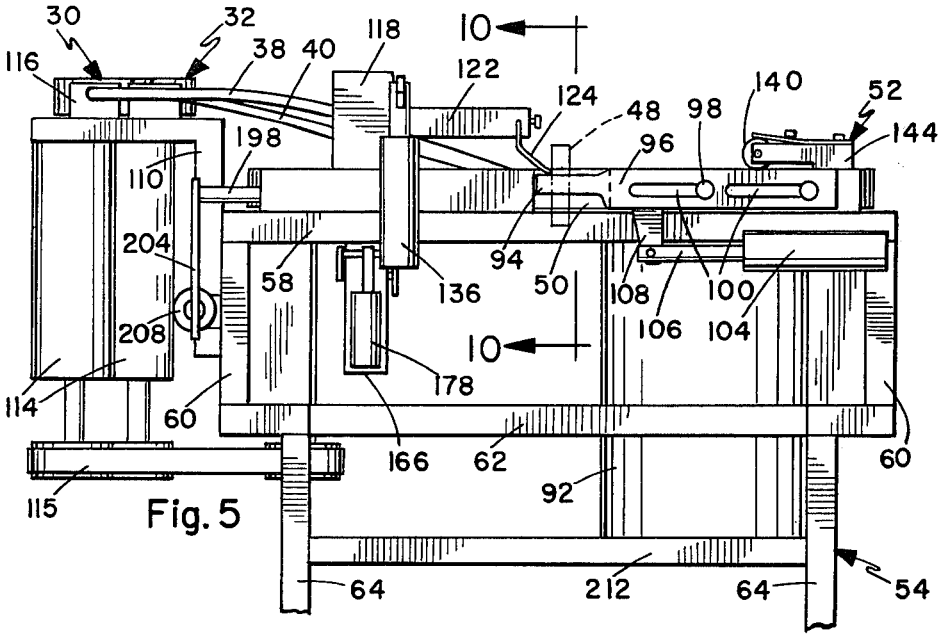
FIG. 5 is a front end elevation view of the apparatus of FIG. 1, taken from the right hand side of FIG. 3. The core feeding mechanism is not shown in this view.
Figure 6:
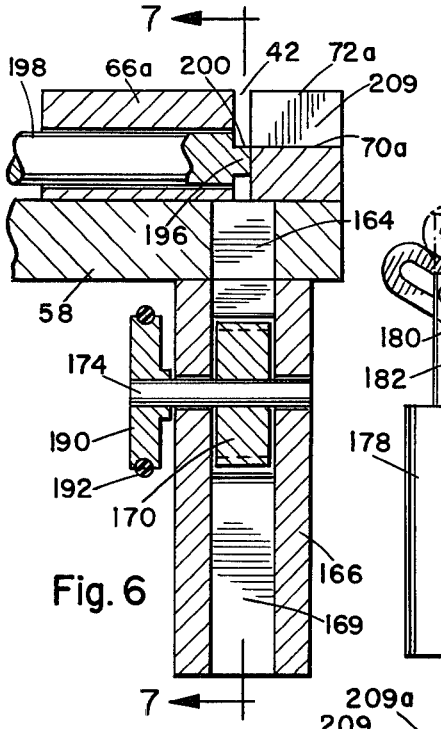
FIG. 6 is an enlarged fragmentary vertical sectional view taken along lines 6—6 of FIG. 3.

The construction and operation of the illustrated embodiment may now be described in detail. As shown in FIGS. 3 and 5, the operative mechanisms of the apparatus are supported by a platform structure 54 which may be constructed from interconnected vertically and horizontally extending planar sections of aluminum or other suitable material. The platform structure includes a pair of vertical, tubular legs such as 56 (FIG. 3) at its rearward end. An upper, horizontally extending rectangular base plate 58 (FIGS. 1, 3 and 5) is supported at its rearward corners by the legs 56 and at its forward corners by vertical struts 60. The forward corners of the lower base plate are in turn supported on the upper ends of fin-like legs 64.

The platform structure 54 includes means for defining the generally U-shaped wire receiving channel. The rearward ends of a pair of similarly formed planar guide pieces 66*a* and 66*b* (FIGS. 1, 3, 9 and 11) are secured in overlapping relationship with the forward corners of the upper base plate 58. The forward ends of the guide plates are spaced apart to define the gap 50 (FIG. 1) and they define a relatively large open area 68 between them. The guide plates are formed with upwardly facing step-like recessed areas 70*a* and 70*b* (FIGS. 9 and 11), respectively, which receive overlapping conformably shaped track pieces 72*a* and 72*b* (FIG. 1) to define the U-shaped channel 42. As shown in FIG. 1, the track pieces are elongated and are spaced apart so as not to obstruct the open area 68 therebetween. Preferably, the upper outer edge 74 of the track piece 72*b* (FIG. 11) is smoothly curved to facilitate the peeling of the wire loops from the channel. Referring to FIGS. 1 and 18, a portion 75 of the upper outer edge of the track piece 72*b* is cut away to provide a gradually inclined ramp from the gap 50. Preferably, the upper surface of the ramp has a radial curvature. The ramp greatly facilitates the initial peeling away of a wire from the channel to form a chord which extends between the wire release means 52 and the core 48 (see FIG. 15).

Figure 11:
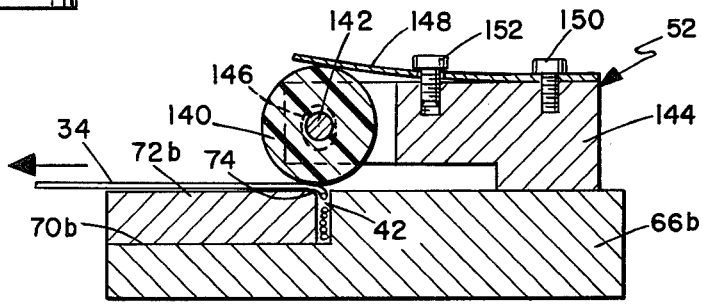
FIG. 11 is an enlarged vertical sectional view taken along line 11—11 of FIG. 1.

Preferably the channel 42 formed by the guide plates and track pieces has a uniform cross sectional area throughout its length. As previously mentioned, it is preferably that the channel has a width of from between about 1 to about 2 times the diameter of the wire which is fed into the channel so that the loops formed therein will be vertically stacked as shown in FIG. 11. The illustrated embodiment is set up for bifilar winding and thus in FIG. 11, the loops of the coil which rests within the channel are formed from alternating ones of the first and second wire strands 34 and 36. The height of the channel is preferably sufficient to accomodate a coil formed from the two strands of wire which is sufficient in length to enable the desired number of turns to be formed about the core. The U-shaped configuration of the channel provides sufficient length for the various wire interacting components to be positioned therearound.

The legs 42*a* and 42*b* of the U-shaped channel (FIG. 1) are spaced apart a distance which is substantially equal to the diameter of the drum 44. The rearward ends of the guide plates 66*a* and 66*b* and the track pieces 72*a* and 72*b* are positioned adjacent the outer annular surface 76 (FIG. 2) of the drum and have a curved contour so that the open ended legs of the U-shaped channel terminate adjacent the drum. As previously described, wire fed into the channel is guided in a generally counter-clockwise direction up the leg 42*a* of the channel to the drum where it is frictionally held between the outer surface of the drum and the belt means 46 which drives the wire into the other leg 42*b* of the channel. Thus the wire is propelled by the drum and by the belt means about an oval-shaped path.

Figure 9:
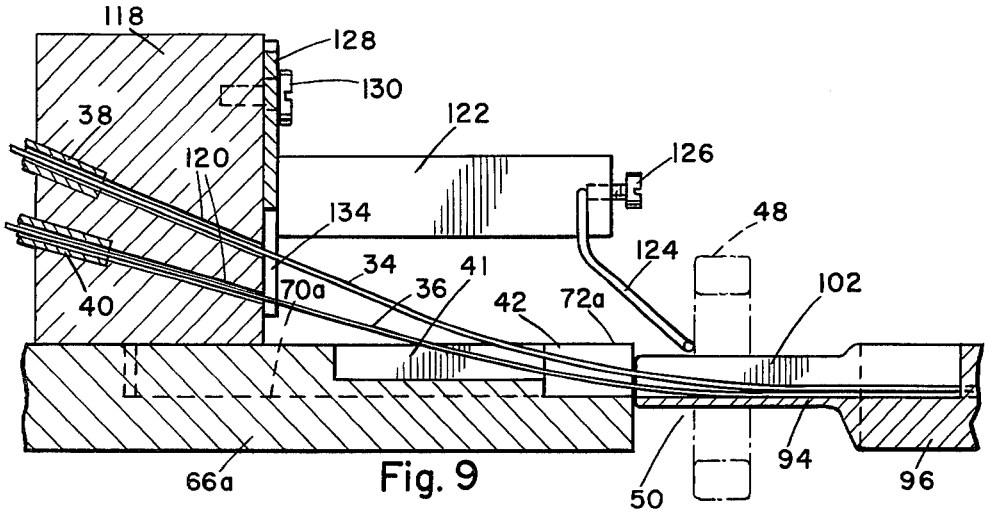
FIG. 9 is an enlarged vertical sectional view taken along line 9—9 of FIG. 3.

Referring to FIG. 1, the tangential slot 41 is formed in the upper surface of the guide piece 66*a*. It extends generally perpendicular to the channel legs 42*a* and 42*b* and feeds into the semi-circular portion of the channel just short of the gap 50. Preferably, the slot 41 has a depth which is less than that of the channel as shown in FIG. 9. The depth and positioning of the slot 41 and the angle and positioning of the guide tubes 38 and 40 is such that the wires 34 and 36 travel horizontally soon after entering the channel.

The outer surface 76 of the drum is formed with an annular recess 78 (FIG. 2) corresponding in height to the height of the channel. This recess is positioned at the same level as the channel and receives the coil 51 therein. The upper periphery of the recess is bounded by a rounded lip 79.

The drum 44 (FIGS. 1 and 2) has a relatively flat cylindrical configuration. It roughly corresponds in thickness to the thickness of the guide plates 66*a* and 66*b*. The drum is mounted for rotation about a vertical axis in overlapping relationship with the upper base plate 58 and is positioned thereon adjacent to the ends of the guide plates and track pieces so that the coil of wire within the channel can readily circulate therearound. The drum has a central axle 80 shown in phantom lines in FIG. 1, which is mounted in a suitable bearing (not shown in the drawings) secured to the base plate 58 so the drum can be rotated at high speed about its central vertical axis. It should be pointed out than the channel extends generally perpendicular to the central axis of the drum. That is, the channel extends vertically between two planes which are both normal to the drums rotational axis. By this arrangement, the vertically extending coil 51 need not twist when passsing from the channel 42 (FIG. 11) into engagement with the outer surface 76 of the drum 44 (FIG. 2). This arrangement further insures that the loops are all driven at a uniform tangential velocity.

As previously mentioned, endless belt means 46 are provided for engaging a portion of the annular outer surface of the drum for drivingly rotating the same. A flexible resilient belt 82 (FIG. 1) rides about idler pulleys 84 and 86, rotatably mounted to the upper base plate 58 on either side of the drum and immediately adjacent thereto. These pulleys are preferably positioned so that a line intersecting their vertical axes will also intersect the axis of rotation of the drum. This permits the belt 82 to engage approximately half of the outer surface of the drum so that when the belt is under suitable tension, a positive driving engagement between the drum and belt is maintained over a relatively great distance. The belt 82 passes around a drive pulley 88 which is rigidly secured to the upper end of the motor shaft 90 of a suitable electric drive motor 92 mounted beneath the base plate 58 (see FIGS. 1 and 3). Hereafter reference numerals 46 and 82 will be used interchangably to refer to the drum drive belt.

An extremely important advantage of the present invention is that the loops of the coil 51 are each rotated or circulated along the oval-shaped path at the same tangential velocity. This is because the loops are vertically stacked in the channel and are positively driven between the drum and the belt 82. Because the recess 78 (FIG. 2) in the drum has a depth which is less than the diameter of the wire, the coil is squeezed between the drum and the belt 82 as is circulates around the drum.

The lip 79 serves to retain the coil in the recess, however, its rounded configuration facilitates the peeling away of the loops from the drum as hereafter described.

Another very important advantage of the present invention is that the coil 51 is bounded on both its inner and outer sides as it is circulated. The inner side walls of the channel 42 and the outer surface 76 of the drum provide the inner boundary. The outer boundary is provided by the outer sidewalls of the channel 42 and the belt 82. Positive guidance is thus provided throughout substantially the entire length of the coil. This permits heavier gage wire to be automatically wound than was previously possible.

The belt 82 is preferably made of a strong resilient material such as synthetic rubber. As shown in FIG. 2, the belt yields somewhat where it overlaps the coil 51 and it firmly squeezes the coil against the outer wall of the drum. This positive drive arrangement eliminates any tendency for the loops to slip relative to one another or to slip relative to the drum and belt. Generally, as the size of the wire to be wound increases, greater pulling forces and tension are required to insure that the turns wound about the core are tight. The positive drive arrangement of the present invention is capable of winding 12 gage and larger size wire.

The positive drive and positive guidance arrangement of the apparatus is also well suited for propelling coils made of wire of a relatively small gage size, for example 38 gage. Of course, depending upon the gage size of the wire being wound, it may be necessary to vary the depth of the annular recess 78 (FIG. 2) in the outer wall of the drum. It may also be necessary to change the width of the channel 42 by varying the positions of the track pieces 72*a* and 72*b* relative to the guide plates 66*a* and 66*b*. The positive drive and positive guidance arrangement further enables greater lengths of wire to be wound about cores than has heretofore been generally possible. Previously when the number of loops became too large, difficulties were encountered in circulating each loop at the same velocity. Tangling and jamming are often the result of this defect. Where pairs of pinch rollers have been utilized to propel the coil, it has been difficult to rotate the loops at a uniform angular velocity. The vertical stacking of the loops in the present invention, combined with the fact that they are each frictionally held between the drum and belt along a large portion of their length, overcomes this problem.

Gap crosser means are provided for selectively bridging the gap 50 (FIG. 1) to complete the channel. A gap crosser 94 in the form of a relatively small finger-like projection is integrally formed to one end of an elongated mounting bar 96. A pair of support studs 98 (FIGS. 5 and 18) extend through respective elongated slots 100 in the bar 96 and are secured in the forward end of the guide plate 66*b* (FIG. 1). The bar is thus supported for selective sliding reciprocating movement so that the gap crosser 94 can be moved from a retracted position to an extended position for selectively bridging the gap 50 to complete the channel.

When the gap crosser is in its retracted position, the core 48 can be moved into the gap in position for the winding operation or moved from the gap after the completion of the winding operation. As shown in FIGS. 1 and 9, the gap crosser 94 is small enough in height and width to provide sufficient clearance so that the turns of wire can be wrapped about the core. The gap crosser further has an upwardly opening groove 102 which conforms in curvature, width, and height to the semi-circular portion of the channel 42. When the gap crosser is moved to its extended position to bridge the gap 50, the groove 102 thus forms a continuation of the channel 42 to guide the circulating coil through the opening of the core. Thus any tendency for the wire to move radially outwardly across the gap 50 so that is would not correctly re-enter the channel if it were unsupported is eliminated. As shown in FIG. 5, selective bridging of the gap by the gap crosser is achieved through the actuation of a spring biased solenoid 104 whose actuating rod 106 is connected to a flange 108 extending from the mounting bar 96.

The wire feeding and braking means 30 and 32 (FIGS. 1 and 3) are identical. For brevity, only the former will be described in detail. Similar parts of the feeding and braking means 32 are indicated by like reference numerals. An inverted L-shaped bracket 110 (FIG. 3) has a vertical leg which is rigidly secured to an outer side edge of the upper base plate 58. Two pairs of opposing pinch rollers 112 are rotatably journaled in any suitable fashion on the upper side of the horizontal leg of the bracket 110. These rollers may be simultaneously rotated at the same speed to pull the wire 34 therebetween to feed it into the channel 42. The pinch rollers are driven in this manner through a train of intermeshing spur gears (not shown in the drawings) which are operatively coupled to an electric clutch/-brake assembly 114 (FIG. 3) mounted to the bracket 110. The pinch rollers are preferably made of a rigid resilient material such as polyurethane so that a positive, non-slip feed can be achieved when the opposing pinch rollers are positioned a suitable distance apart, depending on the wire gage size.

Both of the electric clutch/brake assemblies 114 (FIG. 3) are drivingly coupled to the electric motor 92 through a drive belt 115. This belt is driven around two identical size pulleys 300 mounted on the lower ends of the vertical powers shafts 302 of the clutch/brake assemblies 114. The belt 115 is also driven around a pulley 304 mounted on the lower end of a vertical drive shaft 306 which carries the idler pulley 86 on the upper end thereof. The idler pulley 86 is in turn driven by the motor 92 through the belt 82. The motor 92 must have sufficient power to feed in and circulate heavy wire. In the prototype actually constructed the motor 92 was rated at $\frac{1}{3}$ horse power.

Preferably, the wires are fed into the channel at the same speed that the drum and belt means rotate the coil. Thus the relative diameters of the pulleys 88, 300, and 304, of the drum 44, and of the pinch rollers 112 must be chosen to achieve this speed relationship. It may also be necessary to make the belts 82 and 115 and the aforementioned pulleys with interengaging teeth. The belts can then function as timing belts.

The electric clutch/brake assemblies 114 can be electrically switched between two modes. In their braking mode they firmly hold the pinch rollers against rotation. In their feed mode, a driving connection between the pinch rollers 112 and the always driven power shafts 302 is provided. The assemblies 114 are capable of substantially instantaneously feeding and thereafter braking the wires 34 and 36. One suitable electric clutch/brake assembly is the Model EP-170 sold uner the trademark ELECTRO-PACK by Warner Electric Brake and Clutch Company of Beloit, Wis. It will be understood that the pinch rollers 112 are braked in order to rigidly hold the trailing ends of the wires, thereby initiating the peeling action and the formation of turns about the core as previously described.

Guide blocks 116 are mounted on the brackets 110 and have holes through which the wires 34 and 36 pass. The rearward ends of the guide tubes 38 and 40 are secured to the forward ones of the guide blocks. The forward portion of each of the guide tubes 38 and 40 (FIGS. 1 and 3) is curved inwardly and downwardly toward the channel 42. As shown in FIG. 9, the forward ends of the guide tubes are received in corresponding downwardly directed bores in a mounting block 118 secured on top of the forward periphery of the guide plate 66*a*. The wire strands 34 and 36 pass through downwardly inclined passages 120 through the block and exit therefrom in a direction suitable for facilitating smooth and rapid entry of the wires into the tangential slot 41 and then into the semicircular portion of the U-shaped channel 42. Preferably, the supply spool is aligned so that the precurvature of the wire resulting from being wound about the supply spool facilitates the formation of wire into loops.

Figure 10:
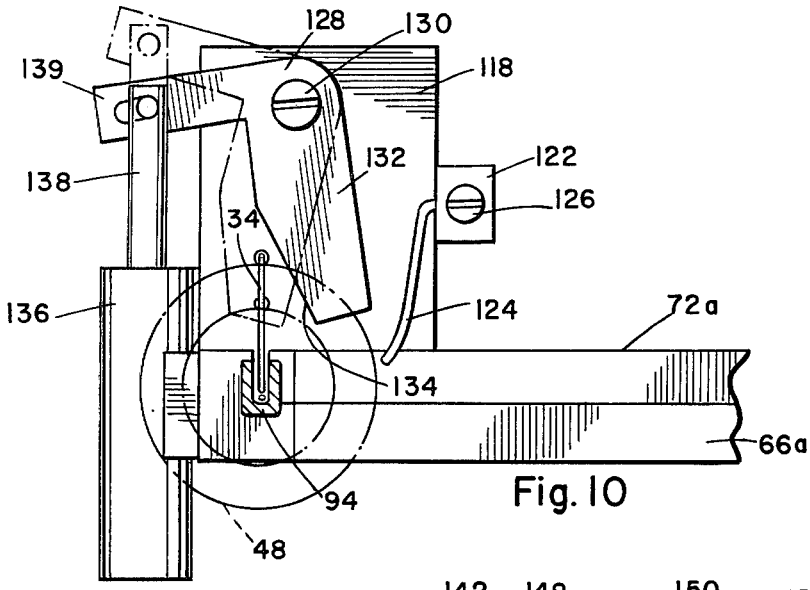
FIG. 10 is an enlarged vertical sectional view taken along line 10—10 of FIG. 5.

Visible in FIGS. 9 and 10 is a boom 122 which is secured to the rearward face of the mounting block and extends toward the gap 50 as shown in FIG. 1. A rigid guide rod 124 (FIGS. 9 and 10) has a rearward end which is rotatably received in a hole in the remote end of the boom. The forward portion of the guide rod is bent downwardly toward the core 48. During the core winding operation, the loops of the wire which are peeled out of the channel and away from the drum engage the rod 124 and are guided downwardly thereby. This insures that each turn is formed midway of the height of the core, at the approximate level of the gap crosser 94. Thereafter the core is rotated about its central axis by the core feeding means hereafter described. The position of the guide rod 124 relative to the core can be adjusted and thereafter fixed by turning a set screw 126.

First shear means are provided for cutting the trailing ends of the wires off from their respective sources. Referring to FIGS. 9 and 10, a planar knife 128 is pivotally mounted in overlapping relationship with one face of the mounting block 118 by means of a screw 130. The knife has a generally downwardly directed blade portion 132 having a vertically inclined cutting edge 134. A vertically mounted spring biased solenoid 136 (FIG. 10) has an actuating rod 138 whose upper end is pivotally connected to the handle portion 139 of the knife 128. The solenoid can be energized to pivot the knife from its position shown in solid lines in FIG. 10, to its position shown in phantom lines. This will cause the blade portion of the knife to swing past the passages 120 in the mounting block 118, shearing off the wires 34 and 36 which exit therefrom. Preferably, the blade portion of the knife is made from tempered steel. This shear mechanism is designed to leave the cut ends unbent and relatively burr free. This is desired since these ends will be the leading ends of the next coil formed so they must be capable of traveling freely in the channel.

Operation of the first shear means may be accomplished at any time after a sufficient number of turns have been wound onto the core to anchor the trailing ends. The braking function of the wire feeding and braking means 30 and 32 is no longer necessary after this anchoring. Severing of the wires at this point is desirable since it permits the core to be slowly rotated as hereinafter described to form each turn adjacent the previous one on the core rather than on top of it.

The number of turns that can be wound on a given core with the illustrated embodiment of the apparatus depends not only on the diameter of the core opening, but on the wire diameter, the length of the channel, and the height of the channel. The smaller the wire diameter is and the larger the other dimensions are, the more turns can be wound on a core of a given cross section. The amount of time it takes to accelerate the wire to a suitable operating speed e.g. 30 feet per second, is minimal because the inertial resistance to acceleration is attributable only to the inertia of the wire itself and not to any additional mass of material, such as a shuttle. Also, since the feeding occurs at the same rate as the circulation of the wire around the channel, the winding begins the instant the feeding stops and there is no time lag during any acceleration of any parts of the mechanism between the feeding and winding. Similarly, the winding is completed at the same speed it began without deceleration of the drum and belt. A real advantage of the apparatus, therefor, is that a continuous succession of wire wound cores can be produced at high speed.

The adjustable wire release means 52 (FIGS. 1 and 11) is utilized to adjust the tension of the turns of wire on the core. A rigid roller 140 is supported on an axle 142 (FIG. 11) which is journaled at its opposite ends in the legs of a fork-like mounting arm 144 secured to the guide plate 66*b*. The roller has a generally oval-shaped hole 146 through which the axle extends so that the roller can move vertically relative to the axle. The roller is positioned so that its bottom outer periphery rests over the channel 42 to normally confine the uppermost loop of wire in the channel. A resilient member, such as a springy steel strip 148, has one end rigidly secured to the upper surface of the mounting arm 144 by a screw 150. The other end of the springy steel strip engages the upper outer periphery of the roller 140 and urges the roller downwardly against the guide plate 66*b* and the track piece 72*b*. The force with which the steel strip urges the roller downwardly is adjustable according to the setting of an adjustment screw 152.

Figure 15:
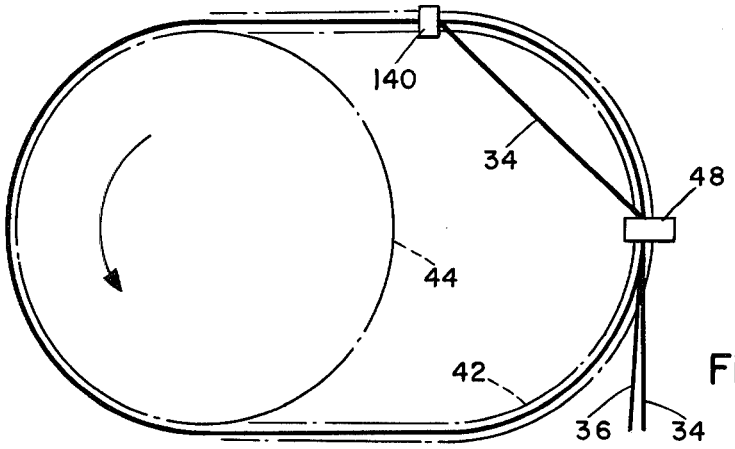
FIGS. 15, 16, and 17 are schematic illustrations depicting bifilar winding of a toroidal core.
Figure 16:
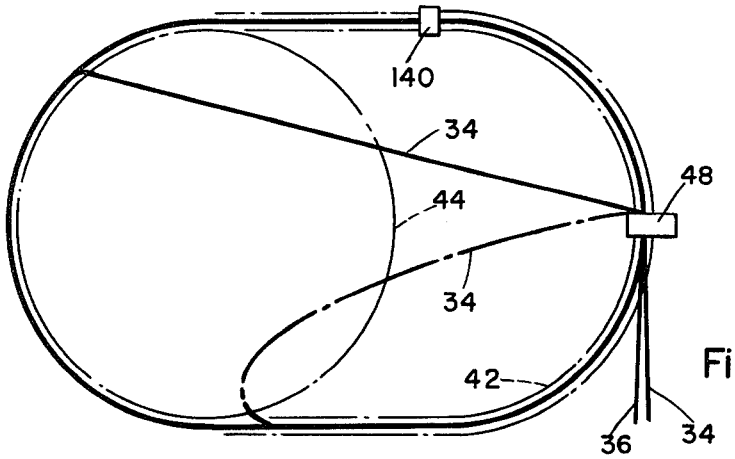
Figure 17:
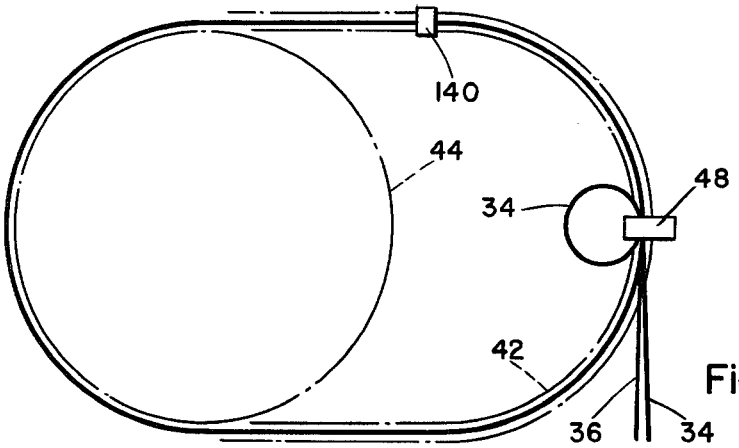

During the core winding operation, wire will initially peel out of the channel and over the ramp portion 75 (FIGS. 1 and 18). As shown in FIG. 15, the wire such as 34 will momentarily extend as a chord between the core 48 and the roller 140. Almost instantly the upward and radially inward forces exerted by the uppermost loop of the wire 34 are sufficient to urge the roller 140 upwardly a sufficient distance to allow the loop to be pulled from the channel between the roller and the track piece 72*b* as shown in FIG. 11. As the coil continues circulating, the uppermost loop of wire 34 peels away from the drum 44 as shown in solid lines in FIG. 16. After the loop of wire 34 has peeled completely away from the drum it begins to feed back into the semi-circular portion of the channel as shown in phantom lines in FIG. 16. Finally, as shown in FIG. 17, the remaining portion of the loop of wire 34 is tightened about the core. The roller 140 prevents the now-uppermost loop of the coil from peeling away into a chord until the newly formed turn is tightened. Thus, the tightness of each of the turns formed about the core is dependent upon how much force is required before a given loop will peel away from the channel underneath the roller 140. By turning the adjustment screw 152 (FIG. 11) the tightness of the turns on the core can be regulated.

The apparatus further includes secondary tensioning means whose principal function is to confine the uppermost loop in the channel at different points along its length with a relatively small amount of force which is readily overcome during peeling. Specifically, referring to FIGS. 1 and 3, whisker elements 154 may be provided at various locations along the U-shaped channel 42. In actuality, a plurality of such whisker elements are utilized, but for simplicity only two have been illustrated. These elements may take the form of resilient wires having one end secured to one of the guide plates 66*a* and 66*b*, and an upturned free end extending into the channel slightly below its upper periphery.

Means are also provided for counting each loop as it is peeled from the channel. Since the peeling of each loop represents the formation of a single turn about the core, it is important to monitor the number of loops that are peeled from the channel so that when a predetermined number of turns have been formed on the core the winding operation can be terminated. The counting means includes a sensor 156 (FIG. 1) which stradles the channel and is positioned adjacent the adjustable release means 52. This sensor is preferably an optical sensor which detects the peeling of a loop as the loop intercepts a scanning beam aimed across the top of the channel. It may include, for example, an LED and a photodiode connected to a conventional electronic counting device (not shown).

Another highly advantageous feature of the present invention is that it is capable of cutting off the leading end of each stand of wire in the coil at the conclusion of the winding operation, while at the same time insuring that the last turns formed about the core are tight. As previously mentioned, in a shuttleness core winder of this type, it is necessary to form more wire into coil which is circulated through the core opening, than will be ultimately wound about the core. This is because there must be sufficient wire to be driven about the oval-shaped path by the drum and belt during the formation of the last turns about the core. The leading ends of the strands of wire are at the bottom of the coil. Therefore, the present invention is provided with a chute mechanism for directing the leading end of each wire downwardly out of the channel and a second shear means for cutting off the leading end after it has travelled down through the chute means. The location and general arrangement of the chute means 158 and the second shear means 160 are shown in FIGS. 1, 3, 6, 7 and 8.

Figure 7:
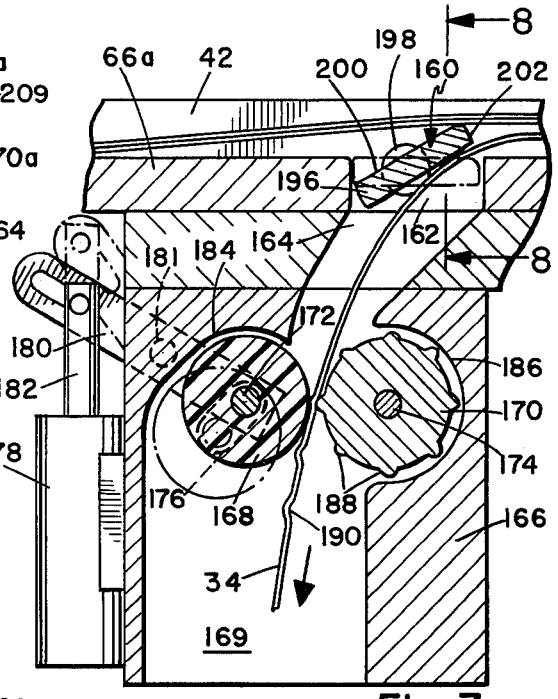
FIG. 7 is a fragmentary vertical sectional view taken along line 7—7 of FIG. 6.

Referring now to FIG. 7, the guide plate 66*a* has a vertically extending slot 162 which extends therethrough at the bottom of the channel 42. A guide aperture 164 extends downwardly and forwardly through the upper base plate 58 and communicates with the slot 162. As hereafter described, the leading end of each strand of wire, such as 34, is directed downwardly through the slot and guide aperture at a predetermined time during the winding operation. Mounted to the underside of the base plate 58 in alignment with the guide aperture 164 is a vertically extending rectangular shear housing 166. The sidewalls of this housing define a chamber 169 whose upper end communicates with the guide aperture so that the strands of wire, such as 34 for example, can be directed downwardly therethrough. A pair of opposing pinch rollers 168 and 170 (FIG. 7) are mounted within the chamber of the shear housing for rotation about respective axles 172 and 174 whose ends are journaled in the sidewalls of the housing.

As shown in FIGS. 3 and 7, the ends of the axle 172 are received in inclined slots 176 formed in the sidewalls of the shear housing. A vertically extending spring biased solenoid 178 is secured to the exterior front surface of the shear housing 166. A linkage arm 180 is mounted for pivotal movement about a pin 181 in overlapping relation with the outer surface of one sidewall of the shear housing 166. The pin 181 is secured in the shear housing sidewall. The linkage arm 180 is pivotally and slidably mounted at one end to the upper end of the actuating rod 182 of the solenoid 178. The other end of the linkage arm has a hole through which the axle 172 of the pinch roller 168 extends. Normally, the actuating rod of the solenoid 178 is spring biased toward its extended position shown in phantom lines in FIG. 7, in which position the linkage arm 180 holds the pinch roller 168 in its retracted position, away from the pinch roller 170. When the solenoid is energized, the actuating rod 182 retracts. The pinch roller 168 is urged toward the pinch roller 170 so that the strands of wire, such as 34, can be squeezed between the pinch rollers and pulled downwardly thereby.

The pinch rollers are received in corresponding arcuate recesses 184 and 186 (FIG. 7) formed in the end walls of the shear housing 166. This helps to insure that the wire strands will be directed downwardly between the rollers instead of behind and around them. The pinch roller 170 is preferably made of hardened steel and has a plurality of radially directed teeth 188 positioned about its circumference. The roller 168 serves as a pressure roller and upon energization of the solenoid 178, the strands of wire are squeezed between the pinch rollers. The roller 168 is preferably made of a resilient material such as polyurethane. The teeth 188 insure that a positive grip of the strands of wire is achieved. The teeth from slight deformations 190 (FIG. 7) in the wire as it passes between the rollers which are driven to pull the wire downwardly through the chamber 169. This positive pulling action is important since it enables the last turns on the core to be tightened while at the same time facilitating the cutting off of the leading ends.

A pulley 192 (FIG. 6) is mounted on one end of the axle 174. An endless drive band 194 is driven around the pulley 192 by suitably drive means, not shown, for rotating the toothed pinch roller 170 to pull the strands of wire downwardly through the shear housing. During the operation of the apparatus, the toothed drive roller is always driven so that pulling action can be accomplished as soon as the solenoid 178 is energized.

The second shear means 160 includes a gate 196 (FIG. 8) which is pivotally mounted in the slot 162 formed in the bottom of the channel 42. It consists of a relatively small rectangular bar which is mounted on the end of a rod 198 (FIGS. 1 and 6) which extends through a bore in the guide plate 66*a* and beyond the side edge thereof. The gate 196 is normally in its closed position (shown in phantom lines in FIG. 7) in which its upper surface 200 (FIG. 6) extends horizontally, sealing the upper end of the slot 162 and forming a portion of the bottom wall of the channel 42. The rod 198 can be rotated in a counter-clockwise direction (FIG. 7) to pivot the gate to its open position shown in solid lines so that the lower surface thereof will engage the leading ends of the wires and direct them downwardly through the slot 162 and the guide aperture 164.

Figure 8:
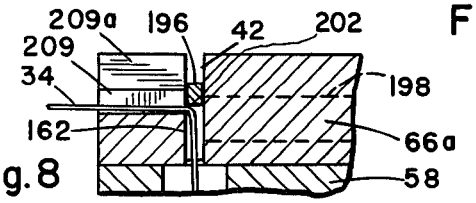
FIG. 8 is a fragmentary vertical sectional view taken along line 8—8 of FIG. 7, showing the cutting of a leading end of a wire.

As best seen in FIGS. 1, 3 and 5, the outer end of the rod 198 is rigidly secured to one end of a linkage arm 204. The other end of the linkage arm is pivotally connected to the actuating rod 206 of a double-acting solenoid 208 mounted in horizontally extending orientation to one of the vertical struts 60 (FIG. 3). The solenoid is normally energized to firmly hold the gate 196 in its closed position shown in FIG. 6. Upon reverse energization of the solenoid 208, the actuating rod 198 is rotated by the linkage arm 204 to swing the gate 106 to its open position shown in solid lines in FIG. 7. The leading ends of the wires are routed into the shear housing and are pulled by its pinch rollers until they slip into a slot 209 (FIGS. 1 and 8) formed in the track piece 72*a*. This slot extends perpendicular to the channel leg 42*b*, slightly rearward of the axis of the rod 198. Eventually, the wires extend tightly from the core 48 line to the slot 209 in a straight line. Upon again reversing the energization of the solenoid 208, the gate closes and the side edge thereof shears off the leading ends of the wires. This can be seen in FIG. 8 where downward movement of the visible end of the gate 196 would cause the wires to be sheared between the lower side edge corner 202 of the gate and the upper side edge corner of the guide plate 66*a*. Preferably, the forward side surface of the slot 209 has a forwardly inclined upper portion 209*a* (FIG. 8). The wires are pulled tightly across this surface just prior to being sheared by the gate 196.

Finally, the apparatus includes core feeding means for supplying and positioning the core 48 in the gap 50 so that the gap crosser can extend through the central opening of the core and the wire can be wound about the core. For simplicity, the core feeding means is not illustrated in FIG. 1, however, it is indicated by reference numeral 210 in FIG. 3. The core feeding means is supported by a horizontal shelf 212 secured to the platform structure 54. The core feeding means is also adapted for rotating the core during the winding operation so that the turns of wire are spaced circumferentially thereabout as previously described. The rotation of the core can be reversed during the winding operation if overlapping turns are desired. The core feeding means 210 includes a vertically inclined chute 214 which contains a supply of cores 216 which are urged downwardly by gravity toward the gap 50.

The structure and operation of the core feeding means will now be described in detail by way of reference to FIGS. 12–14. Each core is fed from the chute 214 into the gap 50 when the gap crosser 94 is in its retracted position. Each core, such as core 48, is supported in the gap by four spools 218, 220, 222 and 224 which firmly engage the outer periphery of the core at four 90° spaced locations. The spools 218 and 220 are carried in tandem arrangement by a vertically movable carriage 226. The spools 222 and 224 are carried along with an additional spool 228 in a triangle configured rotatable assembly 230, hereafter described. Each spool, such as the spool 218 (FIG. 13) includes a central cylindrical section 232 bounded at its opposite ends by annular rims 234 and 236. The spacing between the rims of each of the spools is slightly larger than the thickness of the cores and the rims serve to hold the core in lateral alighnment when supported in the gap.

The lower end of a vertical guide rod 238 (FIGS. 12 and 13) is rigidly secured to the upper horizontal portion of the carriage 226. The upper end of the guide rod extends through a hole 240 through an upper horizontal frame member 242. A coil spring 244 surrounds the guide rod 238 and is squeezed between the frame member 242 and the carriage 226 for urging the spools 218 and 220 downwardly against the core 48. The lower end of a secondary guide rod 246 is also rigidly secured to the carriage. The upper end of a secondary guide rod is received in a hole which extends through the frame member 242. The function of this secondary guide rod is to prevent the carriage from rotating about the guide rod 238. Preferably a cotter pin or some other suitable stop means is utilized to prevent the guide rods 238 and 248 from sliding downwardly out of their corresponding mounting holes in the frame member 242.

The cylindrical sections of the spools preferably have an outer surface made of a material having a high coefficient of friction, such as synthetic rubber, so that rotation of a core held therebetween can only occur through rotation of the spools. The spools 218 and 220 are rotatably mounted about axles 248 whose opposite ends are rotatably journaled in the spaced apart vertical flanges 250 (FIGS. 12 and 13) of the carriage 226. Each of the axles 248 also carries a spur gear such as 252 (FIG. 13), which gears are simultaneously driven by an intermediate spur gear 254 carried by a central axle 256. A pulley 258 mounted on the outer end of the axle 256 is rotated by an endless belt 260 driven by a suitable motor assembly (not shown) for simultaneous rotation of the spools 218 and 220 in the same direction.

Figure 12:
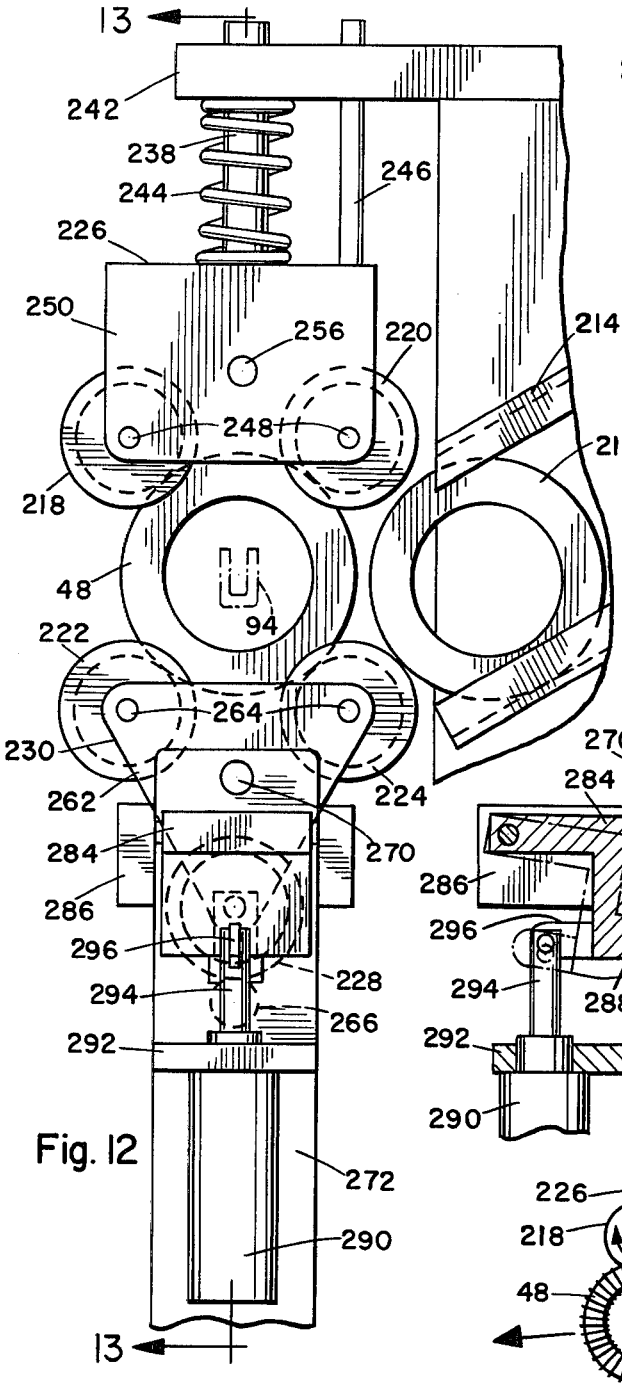
FIG. 12 is an enlarged side elevation view of a portion of the core feeding mechanism.
Figure 13:
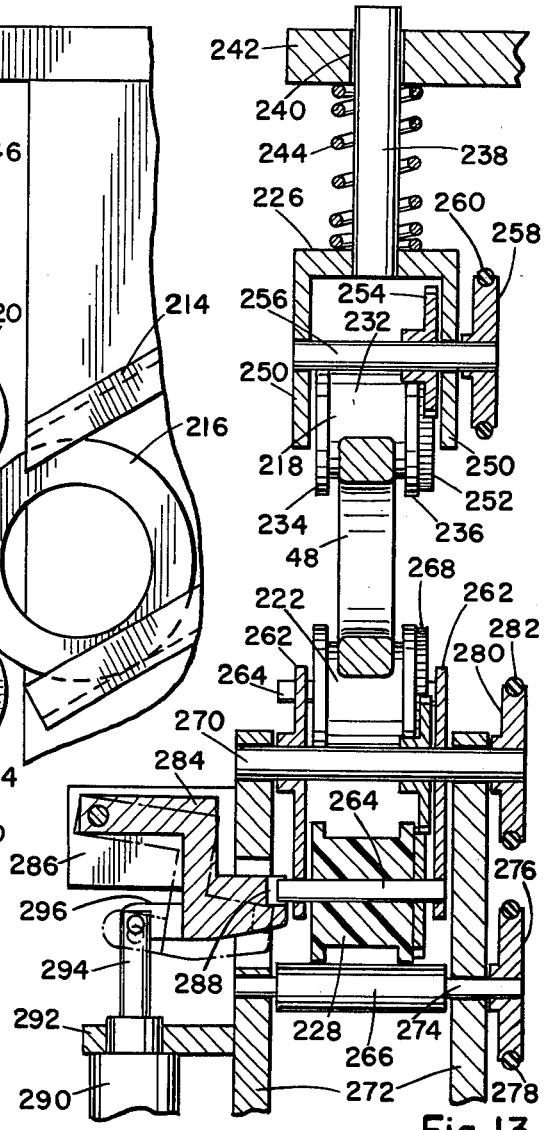
FIG. 13 is a vertical sectional view of the core feeding mechanism taken along line 13—13 of FIG. 12.

Referring to FIG. 12, when a new core is loaded the spools 218 and 220 may be momentarily driven in a clockwise direction so that when they engage the upper outer periphery of a core they tend to push the core into the gap toward the left in FIG. 12. After the core is supported in position in the gap, the rotation of the spools 218 and 220 is terminated. At the conclusion of the winding operation, the wound core is ejected in the direction indicated by the arrow in FIG. 14 with the help of simultaneous clockwise rotation of the spools 218 and 220. It will be observed that as a new core 216 is being loaded into position for winding, the carriage 226 yields upwardly to provide sufficient clearance between the upper and lower spools.

The triangular assembly 230 includes two spaced apart triangular plates 262 (FIGS. 12–14) between which are rotatably mounted the spools 222, 224 and 228. These spools are rotatably mounted on axles 264 whose ends are rotatably journaled in opposing corners of the triangular plates. The spools 222, 224 and 228 can be simultaneously rotated by a friction roller 266 (FIGS. 12 and 13 which can engage the outer rims of any of these spools, depending upon the rotational position of the triangular plate. The rotation of the spool thus driven is transmitted to the other spools through a planetary gear drive mounted between the spools and one of the triangular plates and indicated generally by reference numeral 268 in FIG. 13.

The triangular assembly 230 is supported for rotation about an axle 270 (FIG. 13) which extends through the center of each of the triangular plates. The opposite ends of the axle 270 are rotatably journaled in the upper ends of vertical support members 272 supported by the shelf 212 (FIG. 3). The friction roller 266 (FIG. 13) is rotatably supported by an axle 274 whose opposite ends are also journaled in corresponding holes in the vertical support members 272. A pulley 276 is mounted on one end of the axle 274 and is rotated through an endless drive belt 278 driven by the same motor mechanism that drives the upper spools 218 and 220. Preferably this motor mechanism is of the indexing type which is capable of very minute incremental rotations of the spools. This enables the core 48 to be slowly rotated during the winding operation so that successive turns of the wire are uniformly spaced about the circumference of the core.

Figure 14:
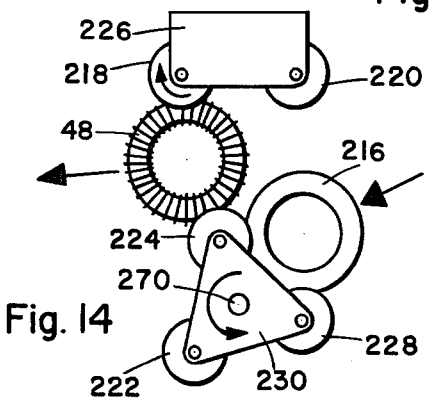
FIG. 14 is a simplified illustration showing the manner in which a completed wound core is ejected from the core feeding mechanism, and the manner in which a new core is supported in position for the next winding operation.

The triangular assembly 230 which carries the lower spools 222, 224, and 228 is adapted for incrementally rotating the spools through an arc of 120° in a counter-clockwise direction as indicated in FIG. 14. This allows a wound core such as 48 to be ejected so that simultaneously a new core 216 can be brought into position in the gap for winding. A pulley 280 (FIG. 13) is mounted on one end of the axle 270 which supports the triangular assembly. This pulley is driven by an endless belt 282 driven by a suitable stepping motor for sequential 120° rotation of the triangle assembly.

Means are also provided for locking the triangular assembly into position immediately after each 120° rotation. Specifically, a rocker arm 284 (FIG. 13) has one end pivotally mounted to a support bracket 286 and a free arm having a cup-shaped recess 288 adapted to receive the end of one of the spool axles 264. When the rocker arm 284 is in its upward position shown in solid lines in FIG. 13, it will confine one of the axles 264 and prevent rotation of the triangular assembly 230. When the rocker arm pivots to its downward position shown in phantom lines in FIG. 13, the recessed end of the rocker arm will move away from the confined axle 264, and enable 120° rotation of the triangular assembly. A vertically oriented spring biased solenoid 290 mounted to a bracket 292 has an actuating rod 294 which is pivotally connected to an ear 296 extending from the rocker arm 284. The spring bias of the solenoid normally biases the rocker arm toward its upward locking position. Upon energization of the solenoid, the rocker arm will be pivoted downwardly to permit 120° rotation of the triangular assembly. When a wound core is being ejected from the core feeding means the triangular assembly 230 is rotated in a counter-clockwise direction as indicated in FIG. 14. Thereafter, de-energization of the solenoid will cause the rocker arm to pivot upwardly to lock the next succeeding axle 264 in position.

It will be observed that the core feeding means of the present invention utilizes four spools for firmly holding the core in position. This is important since during the winding operation the forces exerted by the wires being formed into turns about the core might otherwise shift the position of the core or pull it free from between the spools. This is particularly true when heavy gage wire is being wound where the forces required to pull the loops tightly about the core are considerable.

The motors, electric clutch/brake assemblies, and solenoids heretofore described which actuate the operative components of the apparatus must be sequentially controlled in order for the apparatus to be completely automatic. This control may be accomplished through electro-mechanical means including relays, switches, timers, cams, etc. It is preferable to accomplish this control with the aid of electronic microprocessors. In a prototype of the apparatus which has been constructed and operated, a programmable general purpose mini-computer including a keypunch/CRT terminal has been utilized for controlling the automatic operation. This arrangement facilitates change-over to different core and wire sizes.

Having described in detail the structure of the preferred embodiment of the apparatus, the manner in which it may be utilized to simultaneously wind a core with two different wires (bifilar winding) will now be described. Initially, the motor 92 is energized to start driving rotation of the drum 44 and the power shafts 302 of the clutch/brake assemblies 114. The solenoid 104 (FIG. 5) is energized to move the gap crosser 94 to its retracted position. Thereafter, the core feeding means 210 (FIG. 3) is actuated to feed a core into the gap and lock the same in position for winding. The solenoid 104 (FIG. 5) is then de-energized and the gap crosser moves to its extended position through the central opening of the core. This completes the U-shaped channel 42 as shown in FIG. 1.

The clutch/brake assemblies 114 (FIG. 1) are switched to initiate high speed feeding of the first and second wire strands 34 and 36 from their respective sources. The guide tubes 38 and 40 feed the wires into the tangential slot 41 and then into the channel 42 slightly in advance of the core 48 as shown in FIG. 9. The leading ends of these wires travel in a generally counter-clockwise direction (FIG. 1) up the leg **42*a* of the channel. It may be desirable to delay the brake-to-feed switching of the wire feeding and braking means 32 for a slight time period after that of the feeding and braking means 30** to stagger the leading ends of the wires somewhat. This helps to insure that the loops of the coil are vertically stacked and do not get tangled.

When the leading ends of the wires reach the drum 44 (FIG. 1) they are frictionally held between the outer surface of the drum and the belt 46 and are positively driven about the drum back into the other leg **42*b* of the U-shaped channel. Continued circulation of the leading ends about the oval-shaped path formed by the U-shaped channel and the drum results in a coil of wire being formed in which the loops are vertically stacked. Furthermore, the loops in the coil 51 (FIG. 2) are alternately made of the wire 34 and the wire 36. In effect a series of double loops is formed, each double loop comprising a loop of the wire 34 and a loop of the wire 36. The bottom-most loop is comprised of the wire 36 and the loop immediately above is comprised of the wire 34**.

When a sufficient number of double loops have been formed in the channel, the assembly 114 of the feeding and braking means 30 is switched to its brake mode. This causes the uppermost loop of the coil which is made of the wire 34 to peel away from the channel as shown in FIGS. 15 and 16. At about the time that this loop becomes halfway tightened into a turn about the core, the other assembly 114 of feeding and braking means 32 (FIG. 1) is switched to its brake mode, causing the trailing end of the wire 36 to be braked. Shortly thereafter, the next uppermost loop of the coil, now made of the wire 36, begins to peel away from the channel and from the drum (not shown in the drawings). The first loop made of the wire 34 is almost tightened into a turn about the core at this time.

Continued driving of the coil by the drum 44 and the belt 46 causes the first loop of the wire 34 to be tightened about the core (FIG. 17) and shortly thereafter the first loop of the wire is tightened around the core. During the interval of time between the tightening of the first loop of the wire 34 about the core, and the first loop of the wire 36 about the core, the core 48 is slightly rotated about its central axis by powered rotation of the spools 218, etc., of the core feeding means 210 (FIG. 12). Soon after the first turn of each of the wires 34 and 36 has been tightly wound about the core, the solenoid 136 (FIG. 10) is energized, pivoting the knife 128 and cutting off the trailing ends of the wires 34 and 36 from their sources.

The coil of wire is continuously driven about the oval-shaped path by the drum and the belt. The loops of the wires 34 and 36 continue to peel away approximately 180° out of phase or in alternating fashion so that they do not tangle with each other. Each time a loop is peeled away, an additional turn is wound about the core. The tightness of the cores is dependent upon the predetermined setting of the adjustment screw 152 of the adjustable wire release means 52 (FIG. 11). As these turns are formed the core is rotated about its axis by the core feeding means 210 (FIG. 3). Thus, as shown in FIG. 4, every other turn wound about the core 48 is made from a different one of the wire 34 and 36 and each turn is spaced from the turn immediately preceeding it by a uniform distance. To facilitate having these turns alternate, first one wire and then the next, it is preferred to stop the feeding of the second wire 36 after the leading end of the first wire has advanced around the oval-shaped path from about 45° to about 315°. In this way the tightening of the loops onto the core will be separated sufficiently.

Shortly before the last turns of each of the wires 34 and 36 have been wound about the core, the double acting solenoid 208 (FIG. 3) is energized to cause the gate 196 to swing upwardly to the position shown in solid lines in FIG. 7. At the same time, the solenoid 178 is energized to move the pinch roller 168 adjacent the pinch roller 170, the motor which drives the pinch roller 170 having been previously energized. The leading end of the first wire 34 at the bottom of the coil 51 is first directed downwardly into the shear housing 166 and shortly thereafter the leading end of the second wire 36 does the same. Both wires are tightly pulled downwardly by the pinch rollers 168 and 170 so that as the last turn of each of the wires is wound about the core, the wires are pulled tightly between the core and the slot 209. As soon as this is accomplished, the solenoid 208 (FIG. 3) is reverse energized to pivot the gate 196 to its closed position so that the leading ends of the wires are sheared off.

The solenoid 104 (FIG. 5) is energized to retract the gap crosser 94. Thereafter the core feeding means 210 (FIG. 3) is actuated to eject the completed wound core as shown in FIG. 14. At the same time, a new core 216 is supplied and locked into position between the spools. The steps outlined above are repeated and by this procedure a series of precisely wound cores is produced in rapid succession. The prototype actually constructed is automatically producing 52 bifilar turns of 21 gage copper wire about a toroidal core having an inside diameter of three-quarters of an inch and an outside diameter of one inch at a rate of one unit every twelve seconds.

Having described a preferred embodiment of the improved shuttleless toroidal core winder, it will be apparent to persons skilled in the art that the invention permits of modification in both arrangement and detail. For example, it is contemplated that it may be desirable to utilize dual drums at opposite ends of a relatively large, oval-shaped path so that even greater coil lengths and wire diameters can be accommodated. However, the present invention should be limited only in accordance with the following claims.

We claim:

1. An apparatus for winding a wire having a leading end from a continuous source onto a core having a central opening, comprising:

a drum having an annular outer surface;

means for mounting the drum for rotation about its central axis;

endless belt means for engaging a portion of the annular outer surface to rotate the drum;

means for defining a curved wire receiving channel extending generally perpendicular to the drum axis, the channel having a pair of open ends positioned adjacent the annular outer surface of the drum, a width and a height sufficient to accommodate a predetermined number of vertically stacked lengths of the wire, and a gap therein;

gap crosser means for selectively bridging the gap to complete the channel;

core feeding means for supplying and supporting the core in the gap so that the gap crosser means can extend through the core opening; and wire feeding and braking means for guiding the leading end of the wire into the channel and around the drum during rotation thereof to form the wire into a coil having the predetermined number of vertically stacked loops, the coil being frictionally held between the drum and the belt means and positively driven thereby to circulate it in the channel through the core opening, and further for selectively braking and rigidly holding the trailing end of the wire, whereby when the trailing end of the wire is braked and held as the coil is circulated, the loops will successively peel radially inwardly out of the channel and from between the drum and the belt means and will wind into turns about the core.

2. The apparatus of claim 1, and further comprising:

first shear means for cutting the trailing end of the wire off from the source after the first turn has been formed about the core; and second shear means for cutting off the leading end of the wire after the loops have been wound about the core.

3. The apparatus of claim 2, wherein the second shear means includes:

gate means for directing the leading end of the wire out of the channel; and pinch roller means for pulling the leading end of the wire tight between the core and the gate means prior to cutting off the leading end.

4. The apparatus of claim 1, wherein the channel has a width of from about 1 to about 2 times the diameter of the wire.

5. The apparatus of claim 1, wherein:

the channel has a generally U-shaped configuration including a pair of legs which extend generally perpendicular to the axis of the drum the legs having open ends which are spaced apart a distance substantially equal to the diameter of the drum and which are positioned adjacent the annular outer surface thereof.

6. The apparatus of claim 1, and further comprising:

adjustable wire release means for varying the tension of the turns formed about the core; and secondary tension means at spaced locations along the channel for holding the coil in the channel during the formation thereof.

7. The apparatus of claim 1, and further comprising:

an adjustable guide rod positioned adjacent the gap for engaging the loops of wire which are peeled out of the channel and away from the drum to insure that each turn is formed midway of the height of the core.

8. The apparatus of claim 1 wherein the gap crosser means includes:

a finger-like projection having a groove therein for forming a continuation of the channel; and means for moving the finger from a retracted position in which a core can be positioned in the gap by the core feeding means to an extended position in which the finger extends through the central opening of the core to bridge the gap so that the coil of wire can circulate through the groove.

9. The apparatus of claim 1 wherein the core feeding means includes:

a pair of upper spools and means for rotatably mounting the upper spools in tandem configuration for engaging the upper outer periphery of the core; and three lower spools and means for mounting the lower spools in a triangular configuration so that a pair of the lower spools will engage the lower outer periphery of the core and the core can be ejected by rotating the lower spools through an arc of approximately 120°.

10. The apparatus of claim 1 wherein the drum has an annular recess formed in its outer surface having a height approximately equal to the height of the channel and a width less than the diameter of the wire.

11. The apparatus of claim 1, wherein the endless belt means includes:

a resilient endless belt;

a motor having a shaft;

a drive pulley secured on the end of the motor shaft;

a pair of idler pulleys; and means for rotatably mounting the idler pulleys adjacent the drum so that the belt can be driven around the pulleys to engage approximately half of the outer annular surface thereof, whereby when the belt is under suitable tension, the coil of wire is positively driven between the drum and the belt.

* * * * *